US008936361B2

(12) United States Patent
Okamoto et al.

(10) Patent No.: US 8,936,361 B2
(45) Date of Patent: Jan. 20, 2015

(54) IMAGE FORMING SYSTEM

(75) Inventors: Akira Okamoto, Tokyo (JP); Hideki Nakamura, Tokyo (JP); Kenji Yamamoto, Tokyo (JP); Akifumi Isobe, Saitama (JP); Hiroyuki Futami, Shizuoka (JP); Katsuyuki Ikuta, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 168 days.

(21) Appl. No.: 13/604,985

(22) Filed: Sep. 6, 2012

(65) Prior Publication Data

US 2013/0057626 A1 Mar. 7, 2013

(30) Foreign Application Priority Data

Sep. 7, 2011 (JP) ..... 2011-195155

(51) Int. Cl.
*B41J 2/01* (2006.01)
*G03G 15/23* (2006.01)

(52) U.S. Cl.
CPC ..... *G03G 15/238* (2013.01); *G03G 15/235* (2013.01)
USPC ..... 347/102; 347/101

(58) Field of Classification Search
None
See application file for complete search history.

(56) References Cited

U.S. PATENT DOCUMENTS 7,661,789 B2 * 2/2010 Shimizu ..... 347/22

FOREIGN PATENT DOCUMENTS

| | | | | |
|---|---|---|---|---|
| JP | 07-160066 | A | 6/1995 | |
| JP | 2001-330998 | A | 11/2001 | |
| JP | 2004-286901 | A | 10/2004 | |
| JP | 2007-031041 | A | 2/2007 | |
| JP | 2007-137012 | A | 6/2007 | |
| JP | 2009-300703 | A | 12/2009 | |
| JP | 2010-036995 | A | 2/2010 | |
| JP | 2010-260680 | * | 11/2010 | ..... B65H 9/14 |

OTHER PUBLICATIONS

Japanese Office Action dated Oct. 8, 2013 (and English translation thereof) in counterpart Japanese Application No. 2011-195155.

* cited by examiner

*Primary Examiner* — Geoffrey Mruk
(74) *Attorney, Agent, or Firm* — Holtz, Holtz, Goodman & Chick PC

(57) ABSTRACT

An image forming system has a first image forming section to form an image on a sheet, wherein the first image forming section heats the sheet to fix the image on the sheet, a second image forming section to form an image to the sheet on which the image has been formed by the first image forming section, and a transporting section to transport the sheet from first image forming section to the second image forming section. The transporting section has a first transporting part to transport the sheet to a predetermined position, and a second transporting part to reverse a surface of the sheet which has been transported by the first transporting part as transporting the sheet from the predetermined position to an area below the predetermined position.

7 Claims, 10 Drawing Sheets

IMAGE FORMING SYSTEM

CROSS REFERENCE TO RELATED APPLICATION

This application is based on Japanese Patent Application No. 2011-195155 filed with Japanese Patent Office on Sep. 7, 2011, the entire contents of which being hereby incorporated by reference.

BACKGROUND OF THE INVENTION

1. Field of the Invention

The present invention relates to an image forming system that can print images on both sides of a sheet (duplex printing) by connecting plural image forming apparatuses in series.

2. Description of Related Art

An image forming system connecting plural image forming apparatuses in series has been used in recent years in order to improve productivity when the duplex printing is performed. For example, a system configuration has been known in which two image forming apparatuses are connected in series through a sheet-reversing apparatus. In such a system, an image forming apparatus at an upstream side forms an image on a top surface of the sheet, heats and presses the sheet to fix the formed image on the top surface of the sheet and transports the sheet to a sheet-reversing apparatus. The sheet-reversing apparatus then reverses a surface of the sheet and transports the reversed sheet to an image forming apparatus at a downstream side. The image forming apparatus at the downstream side forms an image on a back surface of the sheet, fixes the formed image on the back surface of the sheet and ejects the fixed sheet to a paper ejection tray. Because such an image forming system forms the images on the top and back surfaces of the sheet by separate image forming apparatuses, a printing speed is improved as compared with a case where one image forming apparatus carries out the duplex printing.

For example, Japanese Patent Application Publications Nos. 2007-137012 and 2009-300703 have disclosed technologies of such an image forming system. Japanese Patent Application Publication No. 2007-137012 has disclosed a printing system in which a plurality of print engines are arranged and by performing an inspection mode where each printing engine prints a predetermined inspection chart on the same surface of the sheet, a determination can be made whether color reproducibility coincides between both print engines or not. Japanese Patent Application Publication No. 2009-300703 has disclosed a printing system in which a plurality of printing devices are connected in series to perform duplex printing and by measuring the images formed on the top surface of the printing sheet and the back surface thereof by sensors, a feedback control for maintaining the color reproducibility in the printing system optimal is performed on the basis of the measured result thereof.

In any of the technologies disclosed in Japanese Patent Application Publications Nos. 2007-137012 and 2009-300703, however, the sheet passed through the image forming apparatus at an upstream side is heated under the fixing step, so that the image forming apparatus at a downstream side receives the heated sheet. Accordingly, in the image forming apparatus at the downstream side, some issues based on temperature rise in the apparatus occur. For example, in the image forming apparatus at the downstream side, any deterioration occurs in materials such as toner or developing materials.

SUMMARY

This invention addresses an issue in the conventional image forming system in which plural image forming sections are connected in series and has an object to provide an improved image forming system. This invention has also another object to provide an image forming system in which plural image forming sections are connected in series, which may prevent temperature rise from occurring in the image forming apparatus at the downstream side and avoid any deterioration in toner or developing materials.

To achieve at least one of the above-mentioned objects or other object, an image forming system reflecting one aspect of the present invention contains a first image forming section to form an image on a sheet while transporting the sheet so that a first edge among four edges of the sheet is to be a leading edge, wherein the first image forming section heats the sheet to fix the image on the sheet, a second image forming section to form an image to the sheet on which the image has been formed by the first image forming section while transporting the sheet so that the first edge is to be the leading edge, and a transporting section to transport the sheet from the first image forming section to the second image forming section with keeping the first edge to be the leading edge of the sheet, wherein the transporting section includes, a first transporting part to transport the sheet to a predetermined position, and a second transporting part to reverse a surface of the sheet which has been transported by the first transporting part as transporting the sheet from the predetermined position to an area below the predetermined position, and to transport the sheet towards the second image forming section.

It is desirable to provide the image forming system wherein the second transporting part contains a third transporting part to reverse the surface of the sheet while transporting the sheet so that a second edge of the sheet which is orthogonal to the first edge is to be a leading edge to a direction perpendicular to a transporting direction by the first transporting part, and a fourth transporting part to transport the sheet which has been transported by the third transporting part towards the second image forming section, wherein the fourth transporting part transports the sheet to the transporting direction by the first transporting part.

It is also desirable to provide the image forming system wherein the transporting section further contains a cooler to cool the sheet which is transported by the first transporting part.

It is further desirable to provide the image forming system wherein the cooler is located under the first transporting part, sucks air below the first transporting part and blows air towards the first transporting part.

It is additionally desirable to provide the image forming system wherein the transporting section further contains a cooler to cool the sheet which is transported by the second transporting part.

It is still further desirable to provide the image forming system wherein the cooler is located under the second transporting part, sucks air below the second transporting part, and blows air towards the second transporting part.

It is still additionally desirable to provide the image forming system wherein the transporting section further contains a cooler to suck air below the first transporting part and to exhaust air towards above the first transporting part, wherein the cooler is located above the first transporting part.

It is further desirable to provide the image forming system wherein the transporting section further contains a fifth transporting part to transport the sheet on which the image is formed by the first image forming section without reversing the surface of the sheet, wherein the fifth transporting part is located under the first transporting part.

It is additionally desirable to provide the image forming system wherein the second transporting part contains a third transporting part to reverse the surface of the sheet as transporting the sheet for a side end of the sheet transported by the first transporting part at a head to a direction perpendicular to a transporting direction by the first transporting part, and a fourth transporting part to transport the sheet which has been transported by the third transporting part towards the second image forming section, wherein the fourth transporting part transports the sheet to the transporting direction by the first transporting part and is shared with the fifth transporting part.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DETAILED DESCRIPTION OF THE PREFERRED EMBODIMENTS

Hereinbelow, typical embodiments of this invention will be explained with reference to the drawings. It should be noted that the present invention is not limited to the embodiments described below. Definitions of terms described below are given by way of explanation of the terms only, and thus the definitions of the terms of the invention are not limited thereto.

1. First Embodiment

<Configuration Example of Image Forming System>

Figure 1:
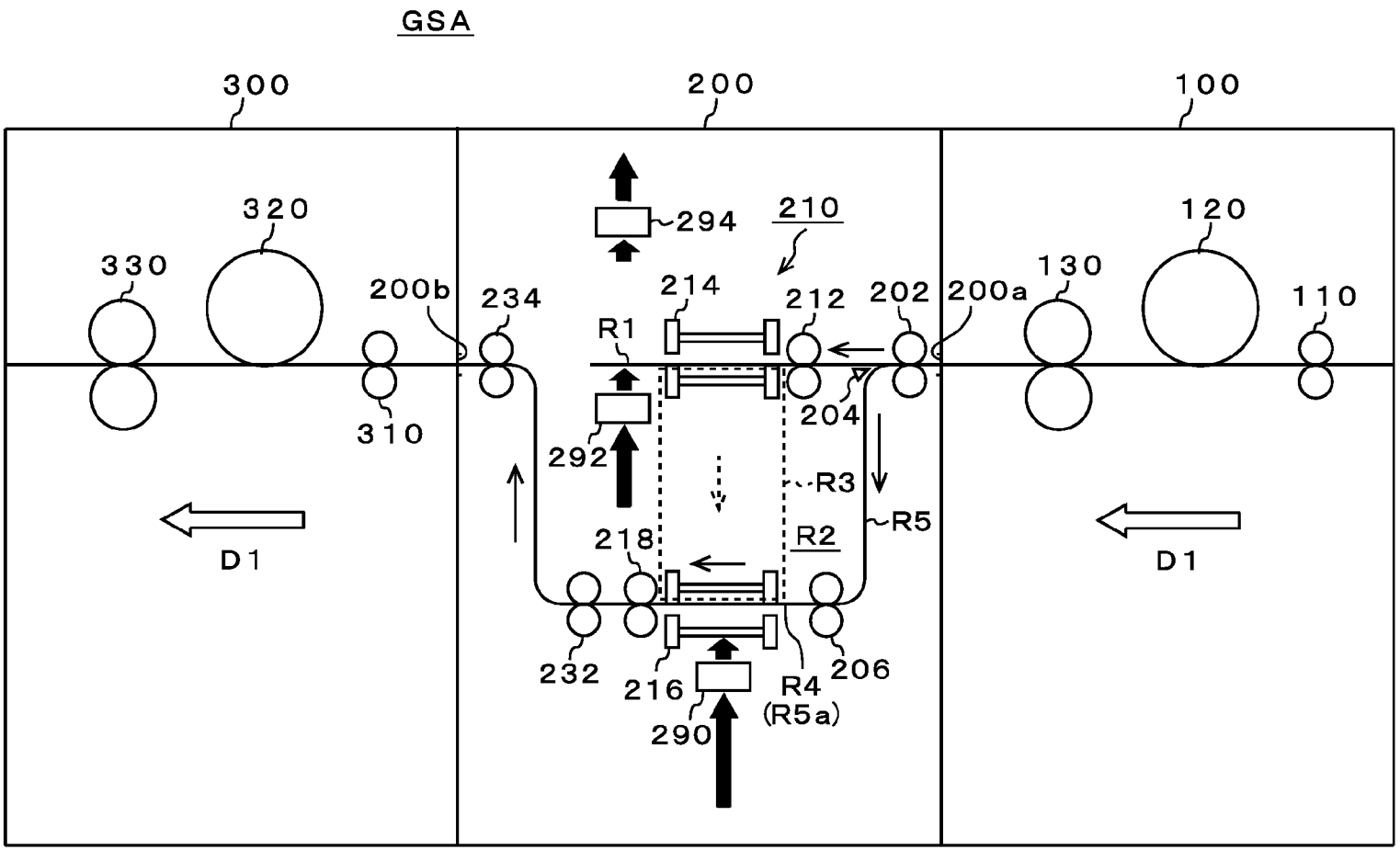
FIG. 1 is a diagram showing a configuration example of an image forming system according to a first embodiment of this invention.

The following will describe embodiments of an image forming system relating to the present invention with reference to drawings. FIG. 1 shows an outline configuration example of an image forming system GSA according to a first embodiment of this invention. The image forming system GSA is provided with a first image forming apparatus 100, an intermediate transporting apparatus 200 and a second image forming apparatus 300, which are connected in series along a transporting direction D1 of the sheet P. In this embodiment, the intermediate transporting apparatus 200 contains a sheet-reversing mechanism 210. In the sheet-reversing mechanism 210, a transporting route R4 is positioned below a transporting route R1. Accordingly, in the sheet-reversing mechanism 210, heat conducts upward from the sheet P heated in the fixing processing of the first image forming apparatus 100 within the intermediate transporting apparatus 200 based on thermal property. Further, heat conducted to guide plates constituting the transporting route R4 is radiated therefrom at the same time.

[Configuration Example of First Image Forming Apparatus]

The first image forming apparatus 100 constitutes an example of a first image forming section and is provided with registration rollers 110, an image forming portion 120 and a fixing portion 130. It is to be noted that an image reading portion, an image forming unit including an exposing portion and a developing portion, a feeder and the like are omitted in FIG. 1 for convenience. Further, hereinafter, it is defined that a transporting direction D2 is perpendicular to the transporting direction D1 and a transporting direction D3 is perpendicular to each of the transporting directions D1 and D2.

By hitting a forward end of the sheet against the registration rollers 110 so that the sheet P is belt like a loop, a deflection of the sheet P is corrected. The registration rollers 110 shift the sheet P to a direction that is perpendicular to the transporting direction D1 based on the detection result of a deviation detection sensor, not shown, with the registration rollers 110 nipping the sheet P so that a deviation of the sheet P is corrected. The registration rollers 110 transport the sheet P on which the corrections of deflection and deviation have been performed to the image forming portion 120 at a predetermined timing.

The image forming portion 120 is composed of a photosensitive drum and the like and transfers a toner image formed around the photosensitive drum to one surface (top surface) of the sheet transported by the registration rollers 110. It is to be noted that although, in this embodiment, the image forming portion forming a monochrome image and having one photosensitive drum has been shown, an image forming portion which forms a color image and has photosensitive drums on which a yellow (Y) toner image, a magenta (M) toner image, a cyan (C) toner image and a black (K) toner image are respectively formed and an intermediate transfer belt on which they are transferred may be used.

The fixing portion 130 is composed of, for example, a heating roller and a pressing roller including a heater. The fixing portion 130 performs a fixing processing, which applies heat and pressure on the toner image transferred on the surface of the sheet P in the image forming portion 120, to fix the toner image on the sheet P. After the fixing process by the fixing portion 130, the sheet P is transported to the following intermediate transporting apparatus 200 via ejection rollers, not shown.

[Configuration Example of Intermediate Transporting Apparatus]

The intermediate transporting apparatus 200 is disposed at a position between the first and second image forming apparatuses 100 and 300. The intermediate transporting apparatus 200 feeds the sheet P ejected from the first image forming apparatus 100 to the second image forming apparatus 300 with or without reversing a surface of the sheet P. The intermediate transporting apparatus 200 constitutes an example of a transporting section. The intermediate transporting apparatus 200 includes the sheet-reversing mechanism 210, a route-switching part 204, a straight transporting route R5 and cooling fans 290, 292 and 294.

The sheet-reversing mechanism. 210 is provided with so-called same edge reversing mechanism which does not reverse a leading end of the sheet P along the transporting direction D1 but reverses a surface of the sheet P. The sheet-reversing mechanism. 210 is also provided with a transporting route R1 for introducing the sheet P to the sheet-reversing mechanism 210 and a reverse-transporting route R2 including transporting routes R3, R4 for reversing the sheet P1. The detail of the sheet-reversing mechanism 210 will be described later.

The cooling fan 290 is disposed below and around the transporting route R4 and sucks air from a position below the transporting route R4 of the intermediate transporting apparatus 200 and blows it to a guide plate which is provided in the transporting route R4. The air stayed in a low position of the intermediate transporting apparatus 200 has low temperature. This is because the air having high temperature rises upward in the intermediate transporting apparatus 200 and the air having low temperature sinks downward in the low position of the intermediate transporting apparatus 200 based on thermal property. Accordingly, by sucking the air from the position below the transporting route R4 of the intermediate transporting apparatus 200 and blowing it to the guide plate which is provided in the transporting route R4, the transporting route R4 is efficiently cooled.

Further, the cooling fan 292 is disposed below and around the transporting route R1 and sucks air from a position below the transporting route R1 of the intermediate transporting apparatus 200 and blows it to a guide plate which is provided in the transporting route R1. Similar to the cooling fan 290, by sucking air from a position below the transporting route R1 of the intermediate transporting apparatus 200 and blowing it to a guide plate which is provided in the transporting route R1, the transporting route R1 is successfully cooled.

The cooling fan 294 is disposed above the transporting route R1 and forcibly sucks air rising from a position below the transporting route R1, air stagnating around the cooling fan 294 and the like and ejects it from the intermediate transporting apparatus 200. This enables the air having high temperature stayed below the transporting route R1 to be surely and rapidly ejected, thereby allowing the transporting routes R1 and R4 to be efficiently and successfully cooled. It is to be noted that a cooling fan may be disposed on the transporting route R3. Such a configuration that a drawing fan is attached to a wall of a case of the intermediate transporting apparatus 200 and draws air from outside of the intermediate transporting apparatus 200 into the intermediate transporting apparatus 200 may be used. In this case, a temperature sensor for measuring the temperature of the outside air and a control part for controlling the operation of the drawing fan based on a result of a measurement of the temperature sensor are preferably provided.

The route-switching part 204 is positioned at a divergence of the transporting route R1 and the straight transporting route R5 in the sheet-reversing mechanism 210. The route-switching part 204 switches the transporting route to the transporting route R1 or the straight transporting route R5, for example, by driving a solenoid, not sown, or the like. A control part 205, which will be described later, controls the route-switching part 204 to perform the switch of the route.

The straight transporting route R5 is a route on which the sheet P ejected from the first image forming apparatus 100 is transported to the second image forming apparatus 200 without reversing the surface of the sheet P. The straight transporting route R5 is used, for example, when any additional printing, which forms an image on the surface of the sheet where an image has been already formed, is performed or when a simplex printing is performed on only a specified sheet in duplex printing operation. The straight transporting route R5 has a configuration such that it extends from a paper-feeding port 200*a* to a low portion of the intermediate transporting apparatus 200, a horizontal part thereof horizontally extends (to the transporting direction D1) by a predetermined distance through a turn portion, and its end turns and extends upward to be connected with a paper-ejecting port 200*b*. In this embodiment, the horizontal part R5*a* of the straight transporting route R5 is a route shared with the transporting route R4 of the sheet-reversing mechanism 210. The horizontal part R5*a* is disposed under the transporting route R1 of the sheet-reversing mechanism 210.

[Configuration Example of Second Image Forming Apparatus]

The second image forming apparatus 300 constitutes an example of a second image forming section and is provided with registration rollers 310, an image forming portion 320 and a fixing portion 330. It is to be noted that an image reading portion, an image forming unit including an exposing portion and a developing portion, a feeder and the like are omitted in FIG. 1 for convenience. Further, since the second image forming apparatus 300 has the same configuration and function as those of the above-mentioned first image forming apparatus 100, descriptions of common portions will be omitted. The image forming portion 320 forms a desired image on a back (the other surface) of the sheet P, a surface of which has been reversed in the sheet-reversing mechanism 210 of the intermediate transporting apparatus 200. The image forming portion 320 also forms a desired image on a top surface of the sheet P transported via the straight transporting route R5, a surface of which has been not reversed. The sheet P which is transported into the second image forming apparatus has been cooled on the transporting route R4 in the intermediate transporting apparatus 200.

[Configuration Example of Sheet-Reversing Mechanism]

Figure 2A:
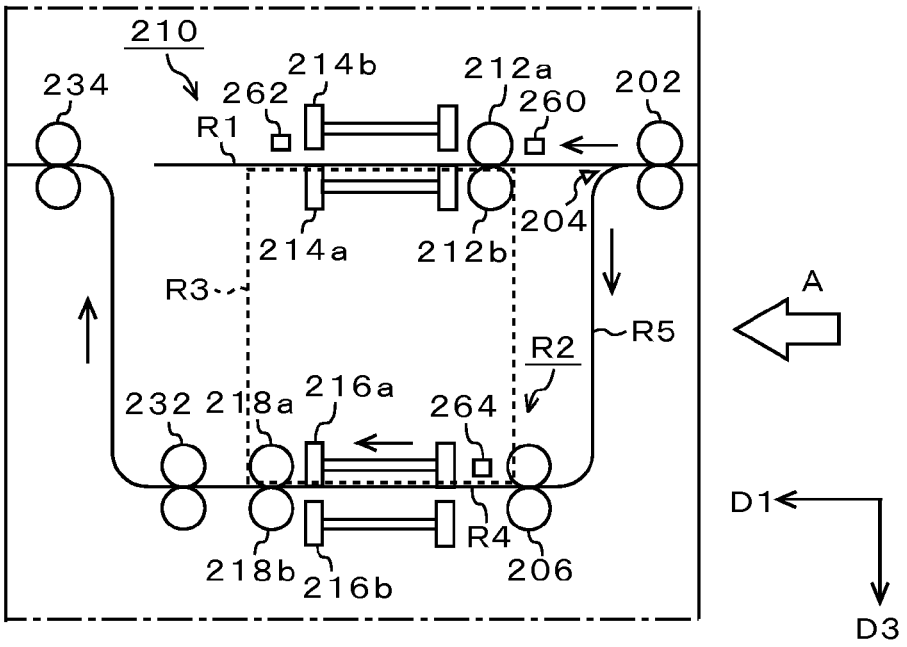
FIG. 2A is a diagram showing a configuration example of a front of a sheet-reversing mechanism.
Figure 2B:
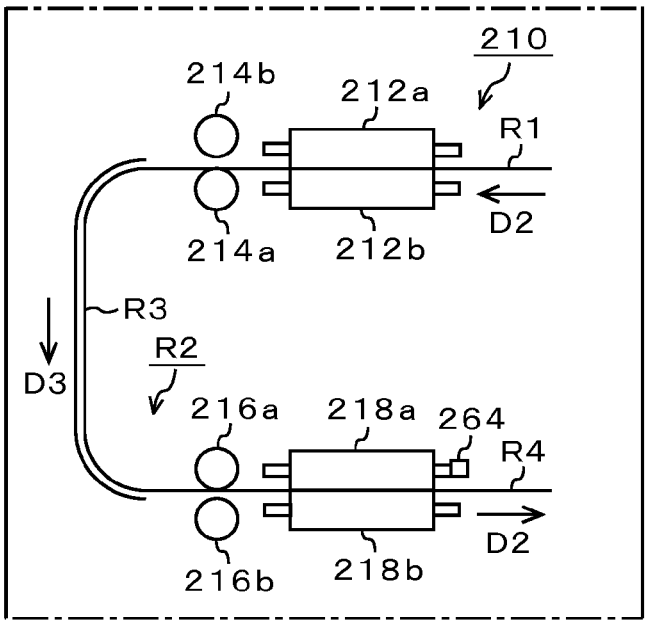
FIG. 2B is a diagram showing a configuration example of a side of the sheet-reversing mechanism.

The following will describe a configuration example of the sheet-reversing mechanism 210 with reference to FIGS. 2A and 2B. FIG. 2A shows a configuration example of a front of the sheet-reversing mechanism 210. FIG. 2B shows a cross sectional configuration example of a side of the sheet-reversing mechanism 210 seen from an arrow A shown in FIG. 2A. As shown in FIGS. 2A and 2B, the sheet-reversing mechanism 210 has the transporting route R1 and the reverse-transporting route R2.

The transporting route R1 is a route on which the sheet P, on which has been done the fixing processing by fixing portion 130 of the first image forming apparatus 100, is transported to the sheet-reversing mechanism 210. The transporting route R1 extends horizontally along the transporting direction D1 by a predetermined distance. This transporting route R1 constitutes a first transporting route and is provided so that a sheet having the largest size of the sheets used in the image forming system GSA can be transported into the sheet-reversing mechanism 210.

Rollers 212 are positioned at an upstream side of the transporting route R1 along the transporting direction D1. The rollers 212 are composed of the driving roller 212*a* and the driven roller 212*b* and transport the sheet P which has been transported from the first image forming apparatus 100 up to the predetermined position along the transporting direction D1.

Rollers 214 are positioned at a downstream side of the rollers 212 on the transporting route R1 along the transporting direction D2. The rollers 214 are composed of the driving roller 214*a* and the driven roller 214*b*. The rollers 214 switch the sheet transporting direction of the sheet P which has been transported up to the predetermined position on the transporting route R1 from the transporting direction D1 to the transporting direction D2 and transport the sheet P to the reverse-transporting route R2 with one side end of the sheet P being a leading end.

The reverse-transporting route R2 is a route on which a leading end and a trailing end of the sheet P along the transporting direction D1 are not switched each other in this route but a surface of the sheet P is reversed. The reverse-transporting route R2 includes transporting routes R3, R4 for reversing the sheet P. The transporting route R3 is positioned at a downstream of the transporting route R1 along the transporting direction D2. The transporting route R3 is composed of a pair of guide plates each having a side shape of, for example, a circular arc. The transporting route R3 is configured so that one end of the transporting route R3 positioned at an upstream of the reverse-transporting route R2 along the transporting direction D2 is connected to the transporting route R1 at a downstream along the transporting direction D2, the other end of the transporting route R3 positioned at a downstream along the transporting direction D2 is connected to the transporting route R4 at an upstream along the transporting direction D2, and the route therebetween is gently curved along a transporting direction D3 of the sheet P. Such a configuration enables the sheet P passing through the reverse-transporting route R2 to be reversed so that a surface of the sheet P is reversed. The reverse-transporting route R2 constitutes a second transporting route.

The transporting route R4 switches the sheet transporting direction of the sheet P, a surface of which has been reversed on the reverse-transporting route R2, from the transporting direction D2 to the transporting direction D1 and transports the sheet P to the second image forming apparatus 300 with the leading end of the sheet P transported on the transporting route R2 along the transporting direction R1, which is the same end of the leading end of the sheet transported on the transporting route R1 along the transporting direction D1, being a leading end. The transporting route R4 constitutes a fourth transporting route. The transporting route R4 is positioned at a lower side of the intermediate transporting apparatus 200 and is disposed below the transporting route R1. Accordingly, since heated air from the sheet P transported on the transporting route R4 rises upward in the intermediate transporting apparatus 200 based on thermal property, a temperature of the sheet P falls down. Further, heated air by heat conducted from the sheet P to a pair of guide plates (metal plates) constituting the transporting route R4 always rises upward in the intermediate transporting apparatus 200 based on thermal property when the sheet P is transported on the transporting route R4. Accordingly, temperature of the guide plates falls down. This enables the transporting sheet P on the transporting route R4 to be prevented from being heated by heat of the guide plates. The transporting route R4 is provided as to have a route length so that the sheet P having the largest size of the sheets used in the image forming system GSA can be held in a straight posture, not flexible. Thus, the heat is released from the sheet P in two dimensions, thereby enabling the sheet P to be effectively cooled.

Rollers 216 are positioned at an upstream side of the transporting route R4 along the transporting direction D2. The rollers 216 are composed of the driving roller 216*a* and the driven roller 216*b*. The rollers 216 draw the sheet P, a surface of which is reversed, received through the transporting route R3, to the transporting route R4. Rollers 218 are positioned at a downstream side of the transporting route R4 along the transporting direction D1. The rollers 218 are composed of the driving roller 218*a* and the driven roller 218*b*. The rollers 218 transport the sheet P drawn to the transporting route R4, a surface of which has been reversed, to the second image forming apparatus 300 along the transporting direction D1 with the leading end of the sheet P transported on the transporting route R2 along the transporting direction D1, which is the same end of the leading end of the sheet P transported on the transporting route R1 along the transporting direction D1, being a leading end.

[Block Configuration of Intermediate Transporting Apparatus]

Figure 3:
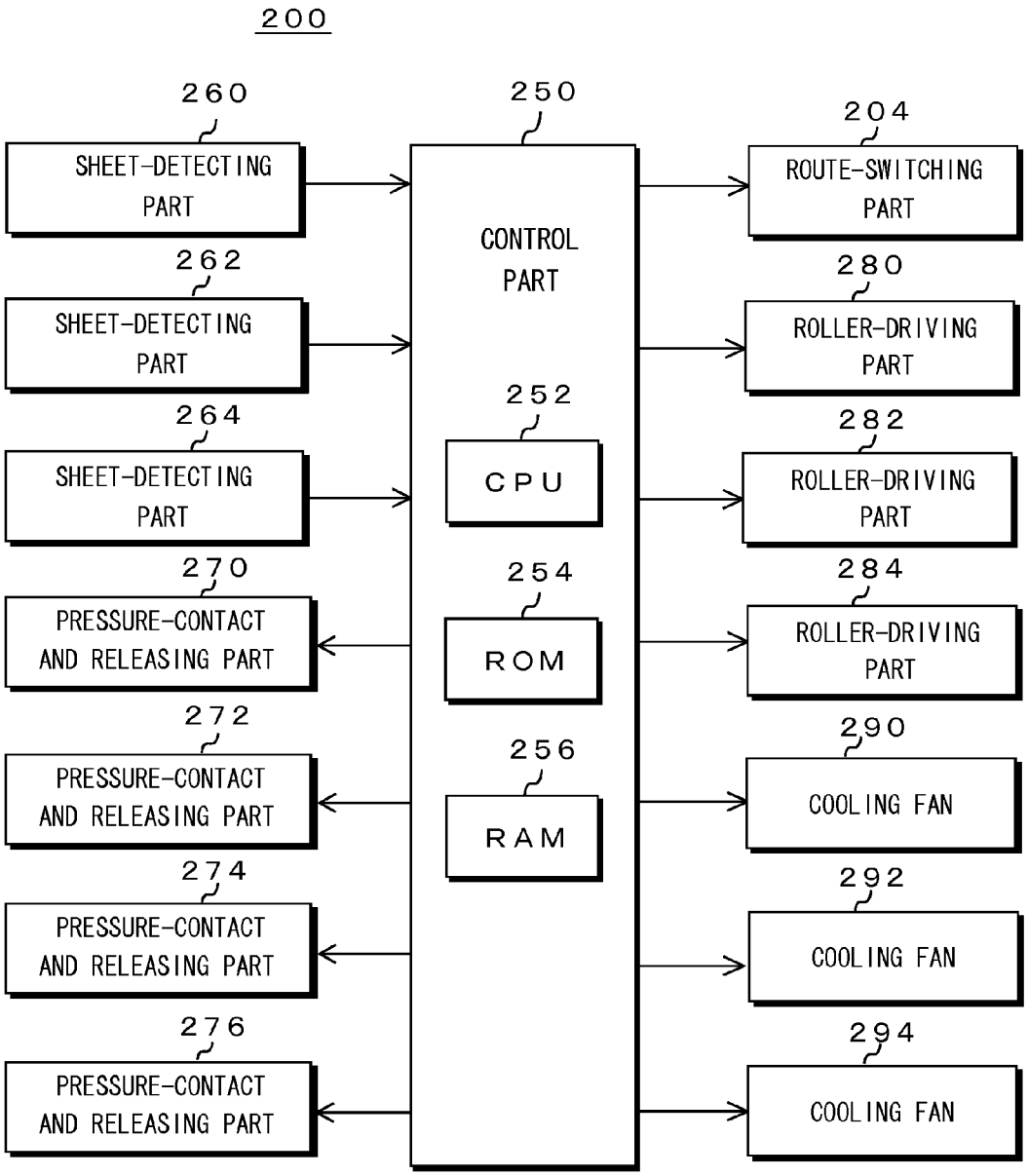
FIG. 3 is a block diagram showing the image forming system for showing a configuration example thereof.

FIG. 3 illustrates a block configuration example of the intermediate transporting apparatus 200. The intermediate transporting apparatus 200 contains a control part 250 controlling an operation of whole of the intermediate transporting apparatus 200. The control part 250 includes a central processing unit (CPU) 252, a read only memory (ROM) 254 and a random access memory (RAM) 256. The CPU 252 performs a sheet-reverse transporting of the sheet P, cooling processing by fans and the like by reading any desired programs stored in the ROM 254 and extracting the programs in the RAM 256 to execute them. It is to be noted that although, in this embodiment, the control part 250 provided in the intermediate transporting apparatus 200 has the intermediate transporting apparatus 200 perform the sheet-reverse transporting of the sheet P and the like, this invention is not limited thereto: For example, a control part provided in the first image forming apparatus 100 may have the intermediate transporting apparatus 200 perform the sheet-reverse transporting of the sheet P and the like or a control part provided in the second image forming apparatus 200 may have the intermediate transporting apparatus 200 perform the sheet-reverse transporting of the sheet P and the like.

The control part 250 connects sheet-detecting parts 260, 262 and 264, pressure-contact and releasing parts 270, 272, 274 and 276, a route-switching part 204, roller-driving parts 280, 282 and 284, and cooling fans 290, 292 and 294, respectively.

The sheet-detecting part 260 is composed of, for example, a sensor of reflection type or transmission type and is disposed at an upstream side of the transporting route R1 (at an upstream side of the rollers 212) on the transporting direction D1. The sheet-detecting part 260 detects a forward end of the sheet P transported from the first image forming apparatus 100 to obtain a detection signal and supplies the detection signal to the control part 250. This detection signal is used as a trigger signal for triggering the pressure-contact or its release of the rollers 212 and 214.

The sheet-detecting part 262 is composed of, for example, a sensor of reflection type or transmission type and is disposed at a downstream side of the transporting route R1 (at a downstream side of the rollers 214) on the transporting direction D1. The sheet-detecting part 262 detects whether or not the sheet P transported to the transporting route R1 is set on a sheet-reversing position to obtain a detection signal and supplies the detection signal to the control part 250. This detection signal is used as a trigger signal for triggering the pressure-contact or its release of the rollers 214, 216 and 218.

The sheet-detecting part 264 is composed of, for example, a sensor of reflection type or transmission type and is disposed at a downstream side of the transporting route R4 (at a downstream side of the rollers 216) on the transporting direction D2. The sheet-detecting part 264 detects whether or not the sheet P transported to the transporting route R4 is set on a sheet-feeding position for transporting the sheet P to the second image forming apparatus 300 to obtain a detection signal and supplies the detection signal to the control part 250. This detection signal is used as a trigger signal for triggering the pressure-contact or its release of the rollers 216 and 218.

The pressure-contact and releasing part 270 contains a solenoid and the like and performs pressure-contact and its release on the rollers 212 based on instructions from the control part 250. The pressure-contact and releasing part 272 contains a solenoid and the like and performs pressure-contact and its release on the rollers 214 based on instructions from the control part 250. The pressure-contact and releasing part 274 contains a solenoid and the like and performs pressure-contact and its release on the rollers 216 based on instructions from the control part 250. The pressure-contact and releasing part 276 contains a solenoid and the like and performs pressure-contact and its release on the rollers 218 based on instructions from the control part 250.

The roller-driving part 280 is composed of, for example, a stepping motor, and drives the driving roller 212*a* based on instructions from the control part 250. The roller-driving part 282 is composed of, for example, a stepping motor, and drives the driving rollers 214*a* and 216*a* based on instructions from the control part 250. The roller-driving part 284 is composed of, for example, a stepping motor, and drives the driving roller 218*a* based on instructions from the control part 250.

The cooling fan 290 is composed of, for example, a sirocco fan or a propeller fan and the like, and drives to suck air and blow the sucked air to the transporting route R4 based on instructions from the control part 250. The cooling fan 292 is composed of, for example, a sirocco fan or a propeller fan and the like, and drives to suck air and blow the sucked air to the transporting route R1 based on instructions from the control part 250. The cooling fan 294 is composed of, for example, a sirocco fan or a propeller fan and the like, and drives to suck air and eject the sucked air having high temperature towards the upper portion of the intermediate transporting apparatus 200 based on instructions from the control part 250.

[Operation Example of Intermediate Transporting Apparatus]

Figure 4A:
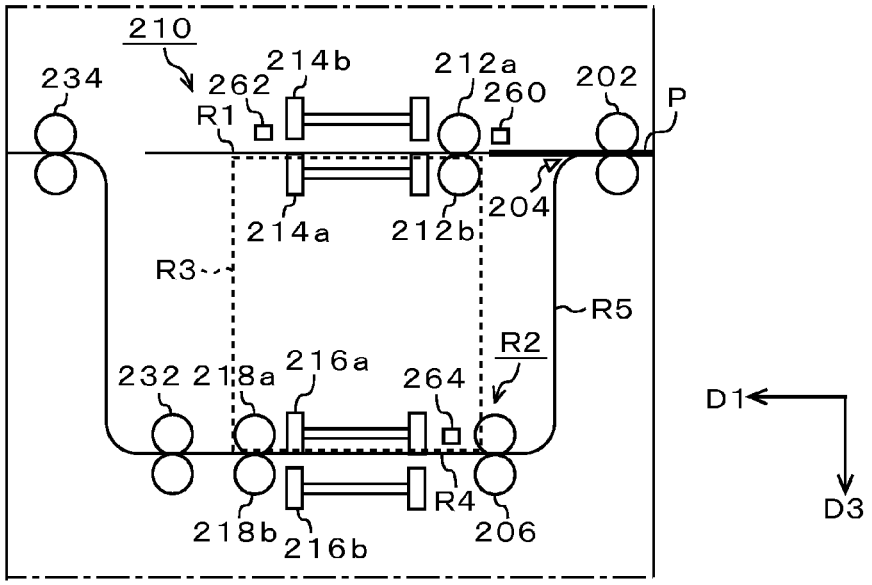
FIGS. 4A and 4B are diagrams of the sheet-reversing mechanism for showing an operation example (Part one)
Figure 4B:
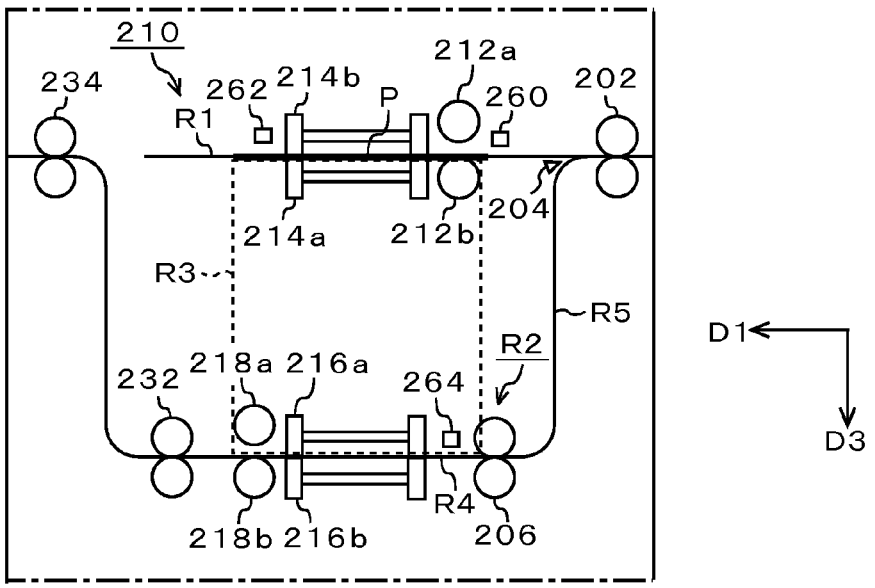
Figure 5A:
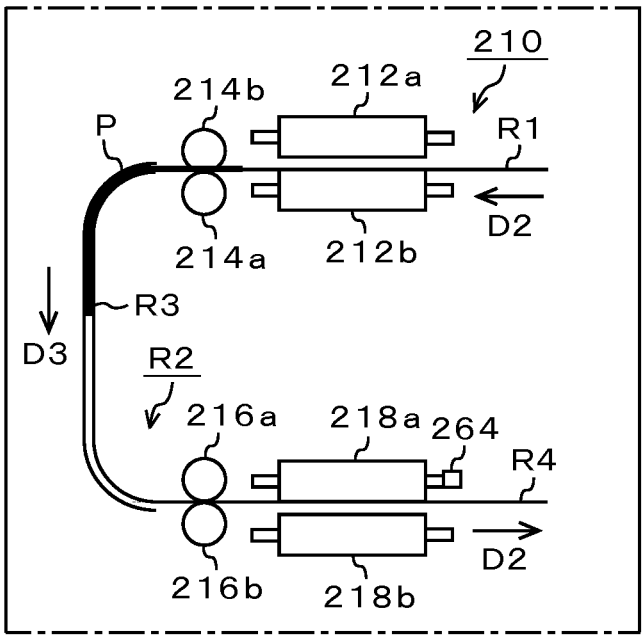
FIGS. 5A and 5B are diagrams of the sheet-reversing mechanism for showing an operation example (Part two)
Figure 5B:
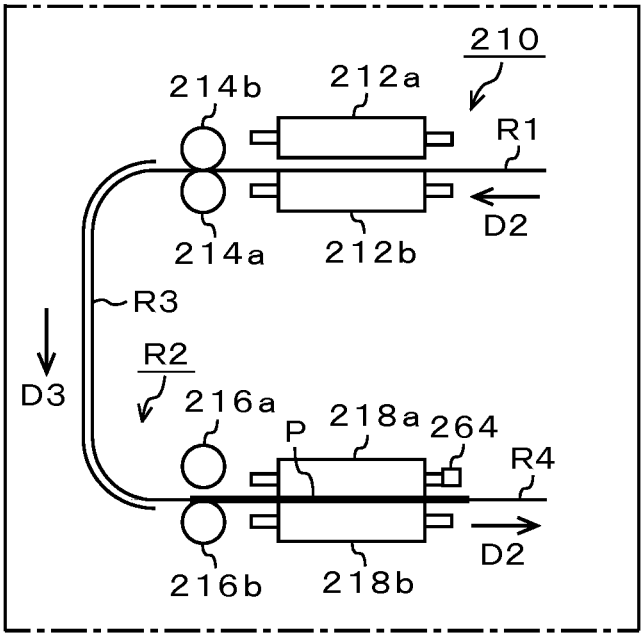
Figure 6:
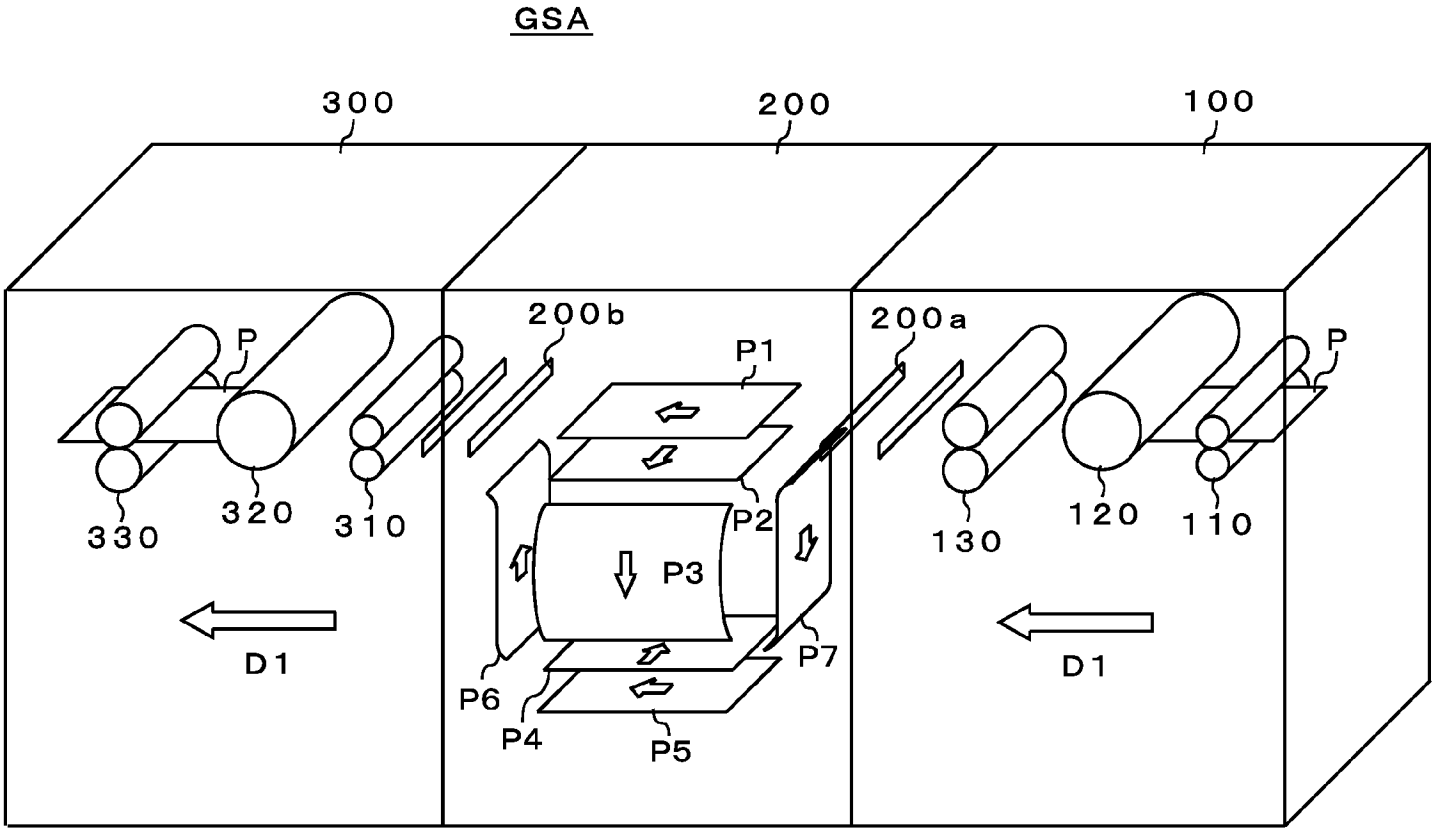
FIG. 6 is a diagram showing a transported situation of sheets in an intermediate transporting apparatus.

The following will described an operation example of the intermediate transporting apparatus 200. FIGS. 4A and 4B show a reversing operation example of the sheet P in the sheet-reversing mechanism 210 of the intermediate transporting apparatus 200, seen from a side thereof on the basis of the transporting direction D1. FIGS. 5A and 5B show the reversing operation example of the sheet P in the sheet-reversing mechanism 210 of the intermediate transporting apparatus 200, seen from the transporting direction D1. FIG. 6 shows a transporting order of the sheet P when the sheet P is transported in the intermediate transporting apparatus 200 with or without a surface of the sheet P being reversed.

First, a case where the image forming system GSA prints images on both surfaces of the sheet P will be described. When the image forming system GSA is turned on, the control part 250 controls the cooling fans 290, 292 and 294 to drive, as shown in FIGS. 1 and 3. The cooling fan 290 blows the air sucked from the lower side of the intermediate transporting apparatus 200 than a position of the transporting route R4 to the transporting route R4. The cooling fan 292 blows the air sucked from the lower side of the intermediate transporting apparatus 200 than a position of the transporting route R1 to the transporting route R1. The cooling fan 294 ejects the air sucked from the lower side of the intermediate transporting apparatus 200 than a position of the transporting route R1 from the upper portion of the intermediate transporting apparatus 200.

When the image forming system GSA prints images on both surfaces of the sheet P, the control part 250 controls the route-switching part 204 to switch the sheet transporting route to the transporting route R1 in the sheet-reversing mechanism 210. The image forming portion 120 of the first image forming apparatus 100 forms an image on a surface of the sheet P. The fixing portion 130 fixes the image onto the surface of the sheet P by heat and the fixed sheet P is transported by the rollers 202 to the transporting route R1 of the sheet-reversing mechanism 210.

When the sheet P is transported into the intermediate transporting apparatus 200 and the sheet-detecting part 260 detects the forward end of the sheet P as shown in FIG. 4A, the control part 250 controls the pressure-contact and releasing parts 270 based on this detection result to perform pressure contact of the rollers 212 and controls the roller driving part 280 to drive the rollers 212. At the same time, the control part 250 controls the pressure-contact and releasing parts 272 to release the pressure contact of the rollers 214. This enables the sheet P to be transported to the sheet-reversing position in the sheet-reversing mechanism 210 (see the sheet P1 shown in FIG. 6).

As shown in FIG. 4B, when transporting the sheet P to the sheet-reversing position on the transporting route R1, the sheet-detecting part 262 detects the sheet P. The control part 250 controls the pressure-contact and releasing part 270 base on the detection result of the sheet-detecting part 262 to release the pressure contact of the rollers 212. The control part 250 also controls the pressure-contact and releasing part 272 to perform the pressure contact of the rollers 214. The control part 250 controls the roller-driving part 282 to drive the rollers 214. Thus, the sheet transporting direction of the sheet P is switched from the transporting direction D1 to the transporting direction D2 and the sheet P is sent to the reverse-transporting route R2 with the side end of the sheet P along the transporting direction D1 being a leading end (see the sheet P2 shown in FIG. 6).

At the same time, the control part 250 controls the pressure-contact and releasing part 274 at the side of the transporting route R4 to perform the pressure contact of the rollers 216 and controls the pressure-contact and releasing part 276 to release the pressure contact of the rollers 218. The rollers 216 drive together with the rollers 214 by the driving of the roller-driving part 282.

When the sheet P is passed through the curbed route like a circular arc as shown in FIG. 5A (see the sheet P3 shown in FIG. 6), the sheet P is reversed 180 degrees so that the surface of the sheet P is reversed and under this condition, the sheet P is transported to the transporting route R4. The rollers 216 then transport the sheet P transported to the transporting route R4 up to a transporting position in the transporting route R4 (see the sheet P4 shown in FIG. 6).

Heated air from the sheet P rises upward in the intermediate transporting apparatus 200 based on thermal property. In this embodiment, since the transporting route R4 is arranged at a lower position of the intermediate transporting apparatus 200 and below the transporting route R1, it is possible for a temperature of the fixed sheet P to fall down by transporting the sheet P on the transporting route R4. Further, heated air by heat conducted from the sheet P to the guide plates constituting the transporting route R4 rises upward in the intermediate transporting apparatus 200. Accordingly, temperature of the transporting route R4 itself falls down.

When, as shown in FIG. 5B, transporting the sheet P to the transporting position on the transporting route R4, the sheet-detecting part 264 detects the sheet P. The control part 250 controls the pressure-contact and releasing part 276 base on the detection result of the sheet-detecting part 264 to perform the pressure contact of the rollers 218. The control part 250 controls the roller-driving part 284 to drive the rollers 218. The control part 250 controls the pressure-contact and releasing part 274 to release the pressure contact of the rollers 216. Thus, the sheet transporting direction of the sheet P is switched from the transporting direction D2 to the transporting direction D1 (see the sheet P5 shown in FIG. 6). The rollers 232 and 234 then transport the sheet P to the second image forming apparatus 300 with the leading end of the sheet P transported on the transporting route R2 along the transporting direction D1, which is the same end of the leading end of the sheet P transported on the transporting route R1 along the transporting direction D1, being a leading end (see the sheet P6 shown in FIG. 6).

The following will describe a straight transporting. The control part 250 controls the route-switching part 204 to switch the route to the straight transporting route R5 when any additional printing, which forms an image on the surface of the sheet where an image has been already formed, is performed or when a simplex printing is performed on only a specified sheet in duplex printing operation. The control part 250 determines whether the straight transporting is executed on the basis of the contents of the print job and any simplex printing information or the like input on a manipulation and display section.

The image forming portion 120 of the first image forming apparatus 100 forms an image on a top surface of the sheet P, the fixing portion 130 fixes the sheet P and the fixed sheet P is transported to the intermediate transporting apparatus 200. The sheet P transported to the intermediate transporting apparatus 200 is transported into the straight transporting route R5 by route switching of the route-switching part 204 (see the sheet P7 shown in FIG. 6).

The sheet P transported to the straight transporting route R5 is fed to the second image forming apparatus 300 through a horizontal route R5*a* (see the sheets P5 and P6 shown in FIG. 6). Here, the horizontal route R5*a* is disposed at a lower position of the intermediate transporting apparatus 200 and below the transporting route R1. Accordingly, when the sheet P is passed through the horizontal route R5*a*, heated air from the sheet P rises upward in the intermediate transporting apparatus 200, thereby enables the temperature of the sheet P to fall down. It is to be noted that, in this moment, the pressure contact of the rollers 216 which are shared by the transporting route R4 and arranged in the horizontal route R5*a* is previously released.

As described above, according to the first embodiment of this invention, since the transporting route R4 is arranged at a position below the transporting route R1 in the sheet-reversing mechanism 210, heated air from the sheet P which has high temperature because of the fixing processing in the first image forming apparatus 100 rises upward in the intermediate transporting apparatus 200 based on the thermal property when a surface of the sheet P is being reversed. Thus, the temperature of the sheet P falls down. Further, since heated air by heat conducted from the sheet P to the guide plates constituting the transporting route R4 rises upward in the intermediate transporting apparatus 200, temperature of the guide plates constituting the transporting route R4 falls down. Accordingly, it is possible to prevent the temperature of the sheet P from rising when the sheet P is passed through the transporting route R4. As a result thereof, the sheet P which has low temperature is transported to the second image forming apparatus 300 so that it is possible to prevent temperature within the second image forming apparatus 300 from rising. This avoids any deterioration of materials such as toner or developing solution in the second image forming apparatus 300.

Further, according to the first embodiment of this invention, since the horizontal route R5*a* of the straight transporting route R5 for simplex printing is disposed at a position below the transporting route R1, heated air from the sheet P rises upward in the intermediate transporting apparatus 200 based on the thermal property even when printing an image on only one surface of the sheet P. Further, heat of the guide plates constituting the straight transporting route R5 is irradiated. Additionally, since the straight transporting route R5 has a longer route length than a line route, a transporting distance can be kept to that extent so that a period of cooling time is extended, thereby enabling the temperature of the sheet P to fall down.

Further, in this embodiment, the cooling fans 290, 292 are respectively arranged at positions below the transporting routes R1 and R4 and around them. The cooling fans 290, 292 suck the air of the lower portion of the intermediate transporting apparatus 200, which has low temperature, and blow the sucked air to the respective transporting routes R1 and R4. This enables the sheet P passed through the respective transporting routes R1 and R4 and the guide plates constituting the respective transporting routes R1 and R4 to be effectively cooled. Further, in this embodiment, the cooling fan 294 is arranged above the transporting route R1. The cooling fan 294 forcibly sucks the air below the transporting route R1, which has high temperature, and ejects the sucked air from the upper portion of the intermediate transporting apparatus 200. This enables heat to be effectively irradiated from the transporting route R4 arranged at a position below the transporting route R1.

2. Second Embodiment

The second embodiment is different from the first embodiment in that in an image forming system GSB according to the second embodiment, the sheet-reversing mechanism 210 is configured so that the transporting route R4 of the sheet-reversing mechanism 210 is provided at approximately the same level as that of the paper-feeding port 200*a* (at a level with the paper-feeding port 200*a*). It is to be noted that other components and operations of the image forming system GSB according to this embodiment apart from the sheet-reversing mechanism 210 are identical to those of the first embodiment so that the identical components are indicated by the same reference numbers, a detailed explanation of which will be omitted.

[Configuration Example of Intermediate Transporting Apparatus]

Figure 7:
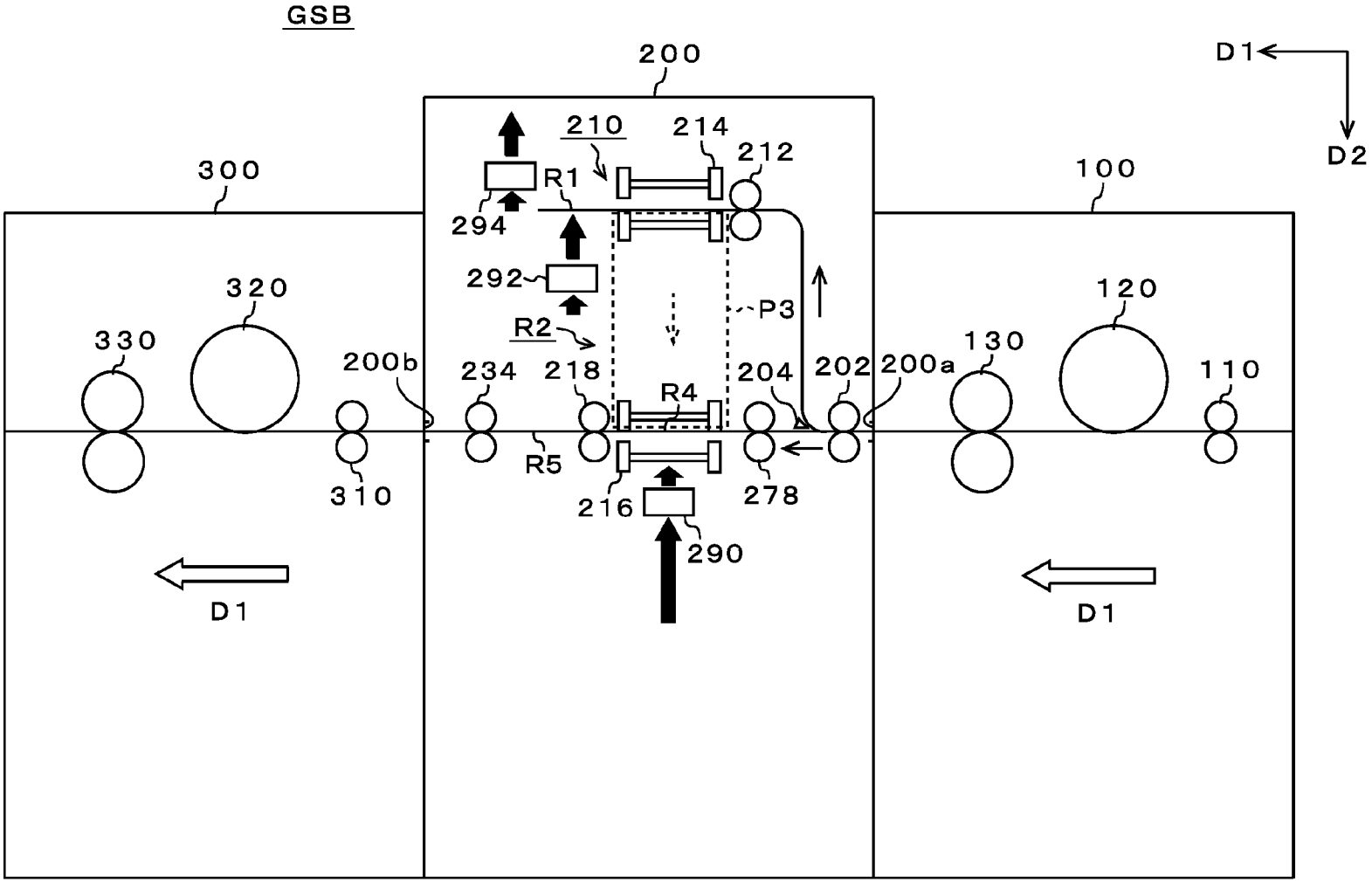
FIG. 7 is a diagram showing a configuration example of an image forming system according to a second embodiment of this invention.

FIG. 7 shows an outline configuration example of the image forming system GSB according to the second embodiment of this invention. The following will describe a configuration of only the intermediate transporting apparatus 200. As shown in FIG. 7, the intermediate transporting apparatus 200 includes the sheet-reversing mechanism 210, a straight transporting route R5 and cooling fans 290, 292 and 294. In this embodiment, the transporting route R4 (or the straight transporting route R5) of the sheet-reversing mechanism 210 is provided at approximately a level with the paper-feeding port 200*a* or the paper-ejecting port 200*b*. The sheet-reversing mechanism 210 is positioned at a position which is higher than that of the first embodiment. In order to house such a sheet-reversing mechanism 210, a case of the intermediate transporting apparatus 200 becomes higher. Accordingly, this case of the intermediate transporting apparatus 200 has a height which is some higher than those of the first and second image forming apparatuses 100, 300.

The sheet-reversing mechanism 210 is provided with the transporting route R1 and the reverse-transporting route R2 including transporting routes R3, R4. The transporting route R1 is a route for introducing the sheet P ejected from the first image forming apparatus 100 to the reverse-transporting route R2. The transporting route R1 extends upward (on the transporting direction D3) from the paper-feeding port 200*a* and a forward end thereof extends on the horizontal direction (or the transporting direction D1) by a predetermined distance via a bending portion.

The transporting route R3 is disposed at downstream side from the transporting route R1 on the transporting direction D2 and is composed of a pair of guide plates, a side shape of each of which is curbed like a circular arc. This transporting route R3 reverses a surface of the sheet P transported from the transporting route R1 by transporting the sheet P therethrough with one side end of the sheet P along the transporting direction D1 being a leading end.

The transporting route R4 is disposed below the transporting route R1 and is provided at approximately the same level as the paper-feeding port 200*a* or the paper-ejecting port 200*b* so as to extend on the transporting direction D1 from the paper-feeding port 200*a* toward the paper-ejecting port 200*b*.

The straight transporting route R5 is provided at approximately the same level as the paper-feeding port 200*a* or the paper-ejecting port 200*b* so as to completely extend along the horizontal direction (the transporting direction D1) from the paper-feeding port 200*a* to the paper-ejecting port 200*b*. In this embodiment, the transporting route R4 is shared by a part of the straight transporting route R5.

[Operation Example of Intermediate Transporting Apparatus]

The following will describe an operation example of the intermediate transporting apparatus 200. It is to be noted that the sheet detections by the sensors and the pressure contacts by the rollers and their release are almost identical to those of the first embodiment, a detailed explanation of which will be omitted.

When the image forming system GSB prints images on both surfaces of the sheet P, the control part 250 controls the route-switching part 204 to switch the transporting route to the transporting route R1 in the sheet-reversing mechanism 210. The image forming portion 120 of the first image forming apparatus 100 forms an image on a surface of the sheet P. The fixing portion 130 fixes the image onto the surface of the sheet P by heat and the fixed sheet P is transported by the rollers 202, 212 to a sheet-reversing position of the transporting route R1 of the sheet-reversing mechanism 210.

When the sheet P has been transported into the sheet-reversing position of the transporting route R1, the sheet transporting direction of the sheet P is switched from the transporting direction D1 to the transporting direction D2 and the sheet P is sent to the transporting route R3 by the rollers 214 and the like with the side end of the sheet P along the transporting direction D1 being a leading end.

When the sheet P sent to the transporting route R3 is passed through the curbed route like a circular arc, the sheet P is reversed 180 degrees so that a surface of the sheet P is reversed. The rollers 216 provided at the downstream side of the transporting route R3 then transport the sheet P to a transporting position in the transporting route R4.

In this embodiment, since the transporting route R4 is arranged at a position below the transporting route R1, heated air from the sheet P, temperature of which has risen by fixing processing in the first image forming apparatus 100, rises upward in the intermediate transporting apparatus 200 based on thermal property, so that temperature of the sheet P falls down. Further, heated air by heat conducted from the sheet P to the guide plates constituting the transporting route R4 rises upward in the intermediate transporting apparatus 200. Accordingly, temperature of the transporting route R4 itself falls down.

When the sheet P is transported to the transporting route R4, the sheet transporting direction of the sheet P is switched from the transporting direction D2 to the transporting direction D1. The rollers 218, the transporting rollers 234 and the like transport the sheet P to the second image forming apparatus 300 with the leading end of the sheet P transported on the transporting route R2 along the transporting direction D1, which is the same end of the leading end of the sheet P transported on the transporting route R1 along the transporting direction D1, being a leading end. Thus, the sheet P, a surface of which is reversed and which is cooled in the transporting route R4, is transported to the second image forming apparatus 300.

When the image forming system GSB prints an image on one surface of the sheet P or prints images on the surface of the sheet P several times, the control part 250 controls the route-switching part 204 to switch the transporting route to the straight transporting route R5. The sheet P which has been fixed in the fixing portion 130 of the first image forming apparatus 100 is transported to the straight transporting route R5. The sheet P transported to the straight transporting route R5 is fed to the second image forming apparatus 300 by the transporting rollers 202, 278, 218, 234 and the like without reversing the surface of the sheet P. In this embodiment, since the straight transporting route R5 is disposed at a position below the transporting route R1, heated air from the sheet P, temperature of which has risen by fixing processing in the first image forming apparatus 100, rises upward in the intermediate transporting apparatus 200 based on thermal property, so that temperature of the sheet P falls down.

As described above, according to the second embodiment of this invention, the same effects are obtained, which are identical to those of the first embodiment of the invention. In other words, since the transporting route R4 on which a surface of the sheet P is reversed is arranged at a position below the transporting route R1 in the sheet-reversing mechanism 210, based on the thermal property on which heated air which has high temperature rises upward in the intermediate transporting apparatus 200, the sheet P transported from the transporting route R1 is cooled on the transporting route R4. Thus, the temperature of the sheet P, the temperature of which falls down, is transported to the second image forming apparatus 300 so that it is possible to prevent materials from being deteriorated in the second image forming apparatus 300 because of the temperature rise in the second image forming apparatus 300.

Further, according to the second embodiment of this invention, the cooling fans 290, 292 are respectively arranged at positions below the transporting routes R1 and R4 and around them. The cooling fans 290, 292 suck the air of the lower portion of the intermediate transporting apparatus 200 and blow it to the guide plates constituting the transporting routes R1 and R4 and the sheet P passing through the transporting routes R1 and R4. This enables the sheet P to be effectively cooled. Further, since the sheet P, temperature of which falls down, is transported to the second image forming apparatus 300, it is possible to prevent materials from being deteriorated in the second image forming apparatus 300 because of the temperature rise in the second image forming apparatus 300.

Additionally, since the transporting route R4 is provided at approximately a level with the paper-ejecting port 200*b*, the sheet P, a surface of which is reversed, is soon transported to the following second image forming apparatus 300. Thus, the sheet P is efficiently transported to the second image forming apparatus 300. When transporting the sheet P without reversing a surface of the sheet P, the sheet P also can be efficiently transported to the second image forming apparatus 300 on the straight.

3. Third Embodiment

The third embodiment is different from the first and second embodiments in that in an image forming system GSC according to the third embodiment, the same end reversing system is not used as the sheet-reversing system but a switchback reversing system is adapted. It is to be noted that other components and operations of the image forming system GSC according to this embodiment are identical to those of the first embodiment so that the identical components are indicated by the same reference numbers, a detailed explanation of which will be omitted.

[Configuration Example of Intermediate Transporting Apparatus]

Figure 8:
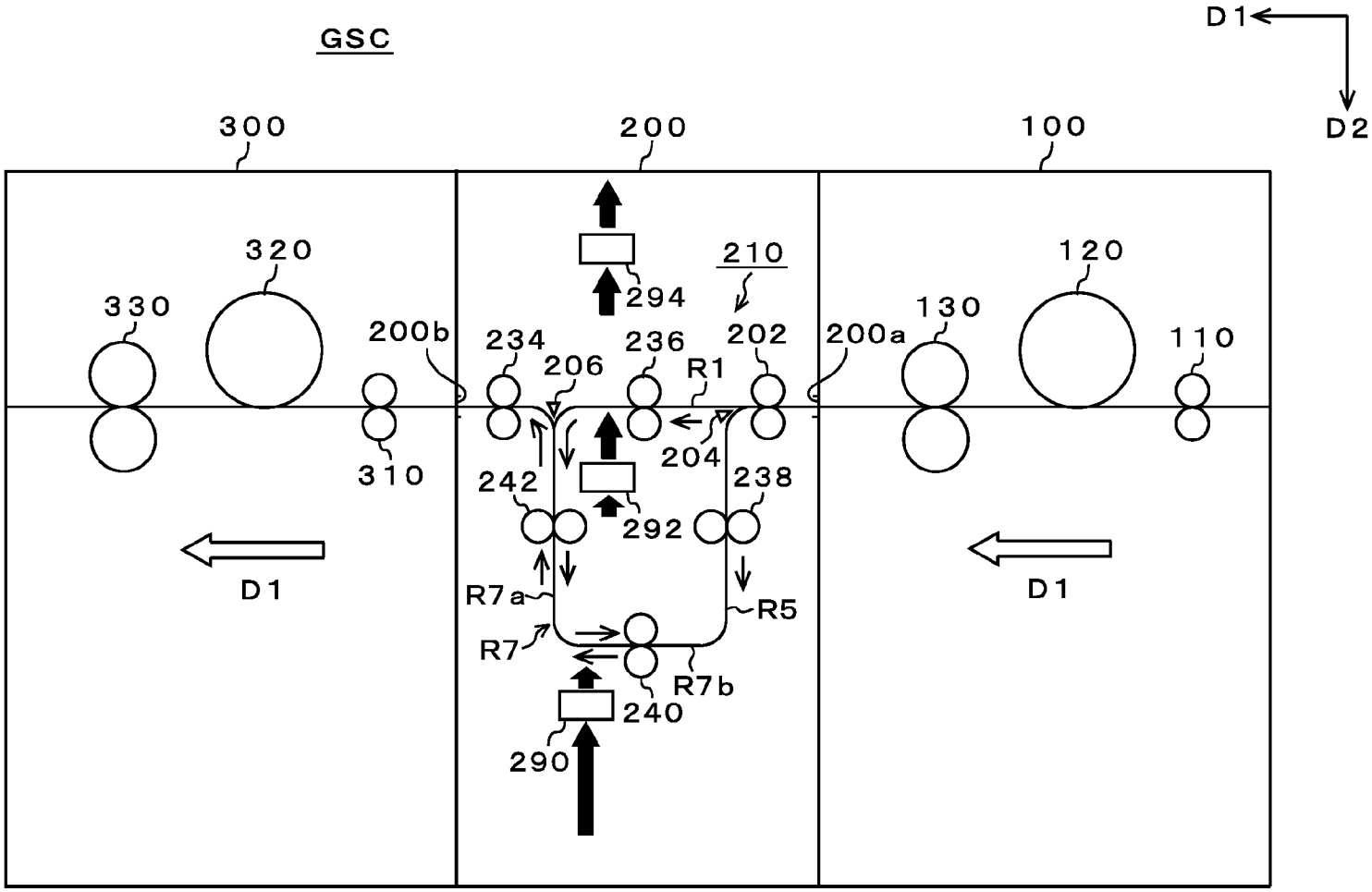
FIG. 8 is a diagram showing a configuration example of an image forming system according to a third embodiment of this invention.

FIG. 8 shows an outline configuration example of the image forming system GSC according to the third embodiment of this invention. The following will describe a configuration of only the intermediate transporting apparatus 200. The intermediate transporting apparatus 200 includes the route-switching parts 204, 206, the transporting route R1, a reverse-transporting route R7, the straight transporting route R5 and cooling fans 290, 292 and 294.

The route-switching part 206 is disposed at a confluence of the transporting route R1 and the reverse-transporting route R7 and switches the transporting route by driving, for example, a solenoid, not shown, to transport the sheet P passed through the transporting route R1 to the reverse-transporting route R7 or to transport the sheet P, a surface of which is reversed in the reverse-transporting route R7, to the second image forming apparatus 300.

The reverse-transporting route R7 is a route having a switchback reversing mechanism. By the switchback reversing mechanism, a leading end and a trailing end of the sheet P along the transporting direction D1 are switched each other and a surface thereof is reversed. The reverse-transporting route R7 contains a vertical route R7*a* extending downward from the transporting route R1 at the downstream side thereof and a horizontal route R7*b* extending from the lower end of the vertical route R7*a* to an opposite direction of transporting direction D1 through a bended portion. The horizontal route R7*b* of the reverse-transporting route R7 is positioned at a position below the middle of the intermediate transporting apparatus 200 and below the transporting route R1.

The straight transporting route R5 extends downward from the paper-feeding port 200*a* in the intermediate transporting apparatus 200 and the lower portion thereof extends horizontally (on the transporting direction D1) by a predetermined distance through a bended portion. The straight transporting route R5 then extends upward to bend the terminal upward facing with the paper-ejecting port 200*b*. In this embodiment, the reverse-transporting route R7 is shared by a part of the straight transporting route R5.

[Operation Example of Intermediate Transporting Apparatus]

Figure 9:
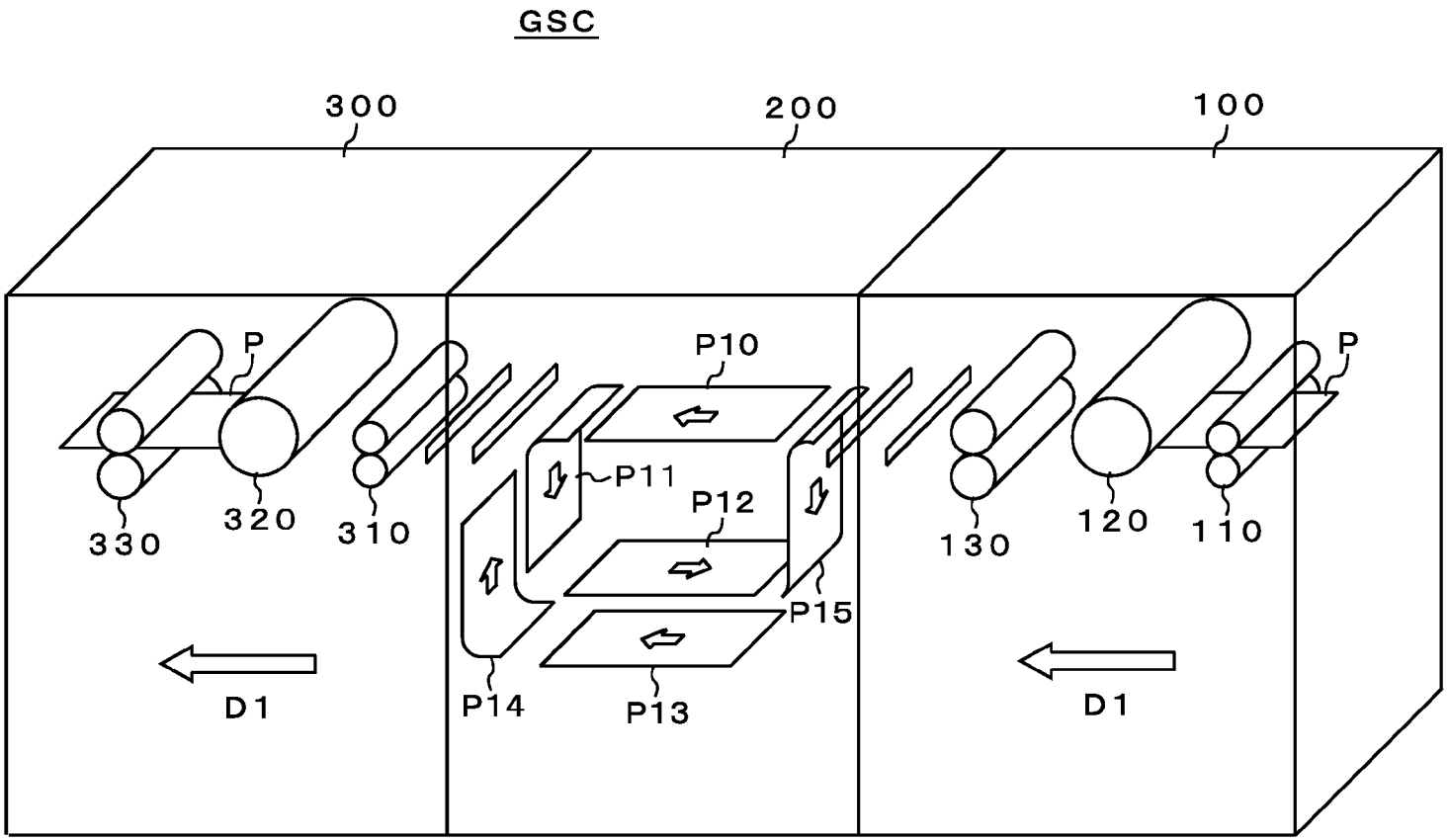
FIG. 9 is a diagram showing a transported situation of the sheet in an intermediate transporting apparatus.

The following will describe an operation example of the intermediate transporting apparatus 200. FIG. 9 shows a transporting order of the sheet P when transporting the sheet P with or without reversing the surface of the sheet P.

First, when the image forming system GSC prints images on both surfaces of the sheet P, the control part 250 controls the route-switching part 204 to switch the transporting route to the transporting rout R1 and controls the route-switching part 206 to switch the transporting route to the reverse-transporting route R7. The image forming portion 120 of the first image forming apparatus 100 forms an image on a surface of the sheet P. The fixing portion 130 fixes the image onto the surface of the sheet P by heat and the fixed sheet P is transported to the transporting route R1 of the intermediate transporting apparatus 200 (see the sheet P10 shown in FIG. 9).

The sheet P transported into the intermediate transporting apparatus 200 is transported into the reverse-transporting route R7 via the transporting route R1 by the rollers 202, 236 (see the sheet P11 shown in FIG. 9). When the sheet P transported into the reverse-transporting route R7, the transporting rollers 242, 240 transport the sheet P to the horizontal route R7*b* with a surface of the sheet P being reversed (see the sheet P12 shown in FIG. 9). Here, since the horizontal route R7*b* is arranged at a position below the transporting route R1, heated air from the sheet P rises upward in the intermediate transporting apparatus 200 based on thermal property, thereby enabling a temperature of the sheet P to fall down. Further, heated air by heat from the pair of guide plates constituting the horizontal route R7*b* rises upward in the intermediate transporting apparatus 200. Accordingly, temperature of the horizontal route R7*b* itself falls down.

By counter rotation of the rollers 240, 242 under a transport control of the control part 250, a sheet transporting direction of the sheet P which has been transported to the horizontal route R7*b* of the reverse-transporting route R7 is reversed and the sheet P is transported to an inverse direction (see the sheet P13 shown in FIG. 9). The sheet P, the leading end and trailing end of which along the transporting direction D1 are switched each other and a surface of which is reversed, is transported to an ejection route R8 via the vertical route R7*a* (see the sheet P14 shown in FIG. 9). The transporting rollers 234 then transport the sheet P transported to the ejection route R8 to the adjacent second image forming apparatus 300.

On the other hand, when the image forming system GSC prints an image on one surface of the sheet P or prints images on the surface of the sheet P several times, the control part 250 controls the route-switching part 204 to switch the transporting route to the straight transporting route R5 and controls the route-switching part 206 to switch the transporting route to the ejection route R8.

The sheet P on which has been done the fixing processing by the fixing portion 130 of the first image forming apparatus 100 is transported to the straight transporting route R5 (see the sheet P15 shown in FIG. 9). In this embodiment, since the straight transporting route R5 is disposed at a position below the transporting route R1, heated air from the sheet P, temperature of which has risen by fixing processing in the first image forming apparatus 100, rises upward in the intermediate transporting apparatus 200 based on thermal property. The sheet P passing through the straight transporting route R5 is then transported to the ejection route R8 (see the sheets P13 and P14 shown in FIG. 9) and is further transported to the second image forming apparatus 300 by the transporting rollers 234 and the like.

As described above, according to the third embodiment of this invention, the same effects are obtained, which are identical to those of the first embodiment of the invention. In other words, since the reverse-transporting route R7 on which a surface of the sheet P is reversed is arranged at a position below the transporting route R1 in the sheet-reversing mechanism 210 and at a lower position of the intermediate transporting apparatus 200, based on the thermal property on which heated air which has high temperature rises upward in the intermediate transporting apparatus 200, the sheet P transported from the transporting route R1 is cooled on the reverse-transporting route R7. Thus, the temperature of the sheet P, the temperature of which falls down, is transported to the second image forming apparatus 300 so that it is possible to prevent materials from being deteriorated in the second image forming apparatus 300 because of the temperature rise in the second image forming apparatus 300.

Further, according to the third embodiment of this invention, the cooling fans 290, 292 are respectively arranged at positions below the transporting route R1 and the reverse-transporting route R7 and around them. The cooling fans 290, 292 suck the air of the lower portion of the intermediate transporting apparatus 200 and blow the guide plates constituting the transporting route R1 and the reverse-transporting route R7 and the sheet P passing through the transporting route R1 and the reverse-transporting route R7. This enables the sheet P to be effectively cooled. Further, since the sheet P, temperature of which falls down, is transported to the second image forming apparatus 300, it is possible to prevent materials from being deteriorated in the second image forming apparatus 300 because of the temperature rise in the second image forming apparatus 300.

4. Fourth Embodiment

The fourth embodiment is different from the first through third embodiments in that in an image forming system GSD according to the fourth embodiment, the switchback reversing system is adapted as the sheet-reversing system and the straight transporting route R5 is configured so as to be a horizontal route. It is to be noted that other components and operations of the image forming system GSD according to this embodiment are identical to those of the first through third embodiments so that the identical components are indicated by the same reference numbers, a detailed explanation of which will be omitted.

[Configuration Example of Intermediate Transporting Apparatus]

Figure 10:
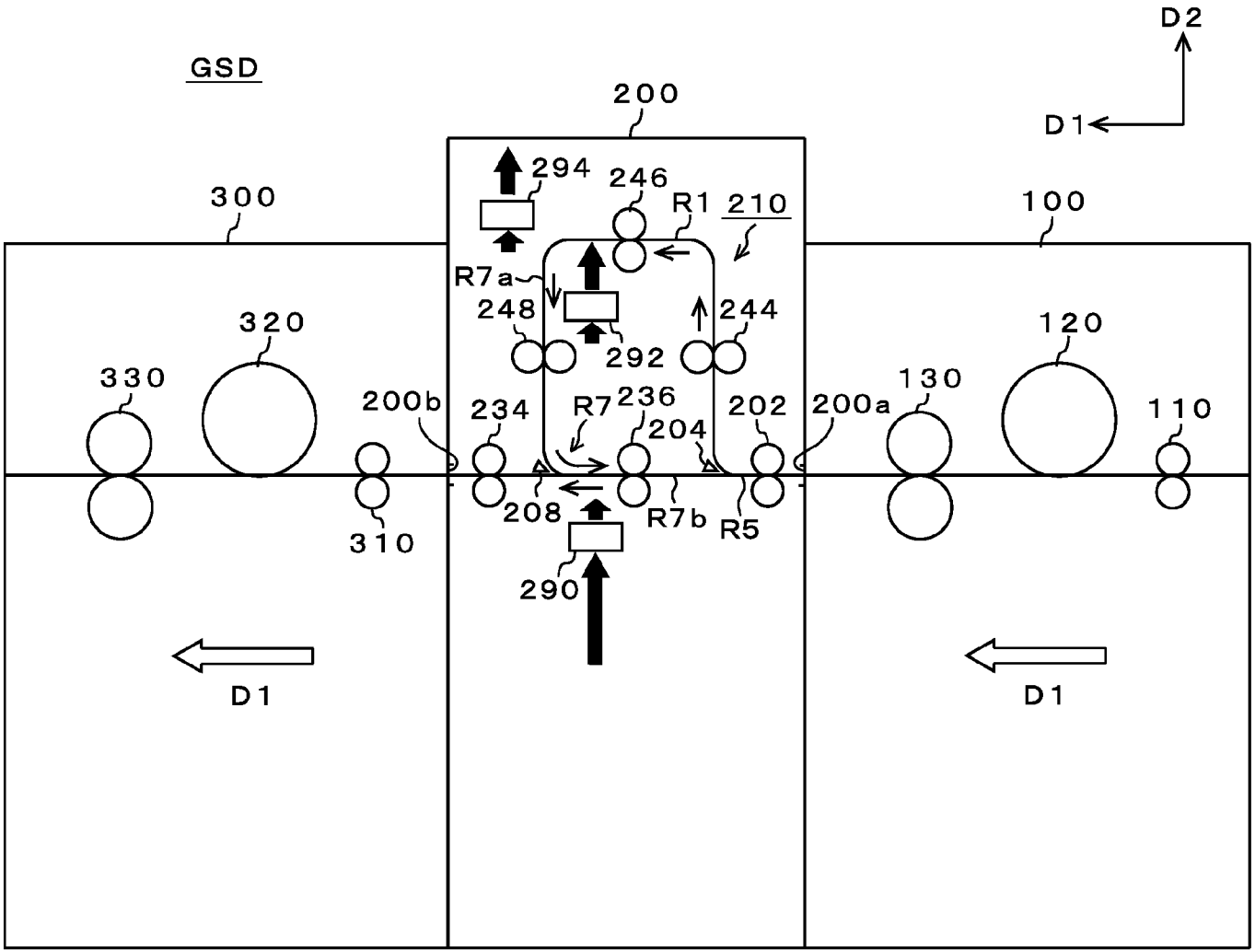
FIG. 10 is a diagram showing a configuration example of an image forming system according to a fourth embodiment of this invention.

FIG. 10 shows an outline configuration example of the image forming system GSD according to the fourth embodiment of this invention. The following will describe a configuration of only the intermediate transporting apparatus 200. As shown in FIG. 10, the intermediate transporting apparatus 200 includes the route-switching parts 204, 208, the transporting route R1, the reverse-transporting route R7, the straight transporting route R5 and cooling fans 290, 292 and 294.

The transporting route R1 is a route for transporting the sheet P ejected from the first image forming apparatus 100 to the reverse-transporting route R7 and has a configuration such that it extends upward from a paper-feeding port 200*a* (to the transporting direction D3) and a forward end thereof extends horizontally (to the transporting direction D1) by a predetermined distance through the bended portion. The transporting rollers 244, 246 are provided in the transporting route R1.

The reverse-transporting route R7 contains a vertical route R7*a* extending downward from one end of the transporting route R1 at the downstream side thereof and a horizontal route R7*b* extending from the lower end of the vertical route R7*a* to an opposite direction of transporting direction D1 through a bended portion. The horizontal route R7*b* of the reverse-transporting route R7 is positioned at a position below the transporting route R1. The transporting rollers 248 are provided in the vertical route R7*a* and the transporting rollers 236 are provided in the horizontal route R7*b*.

The straight transporting route R5 is provided at approximately the same level as the paper-feeding port 200*a* or the paper-ejecting port 200*b* so as to completely extend along the horizontal direction from the paper-feeding port 200*a* to the paper-ejecting port 200*b*. In this embodiment, the horizontal route R7*b* of the reverse-transporting route R7 is shared by a main part of the straight transporting route R5. The transporting rollers 202, 234 and 236 are provided in the straight transporting route R5.

[Operation Example of Intermediate Transporting Apparatus]

The following will describe an operation example of the intermediate transporting apparatus 200 with reference to FIG. 10.

First, when the image forming system GSD prints images on both surfaces of the sheet P, the control part 250 controls the route-switching part 204 to switch the sheet transporting route to the transporting route R1 and controls the route-switching part 208 to switch the sheet transporting route to the reverse-transporting route R7. The sheet P on which the fixing portion 130 of the first image forming apparatus 100 fixes an image by heat is transported to the transporting route R1 of the intermediate transporting apparatus 200 by rotation of the rollers 202, 204. The transporting rollers 246 then transport the sheet P, which has been transported into the transporting route R1, into the reverse-transporting route R7. When the sheet P is transported into the reverse-transporting route R7, the transporting rollers 248 transport the sheet P to the upper vertical route R7*a* and transport the sheet P to the lower horizontal route R7*b* with a surface of the sheet P being reversed. Here, since the horizontal route R7*b* is arranged at a position below the transporting route R1, heated air from the sheet P transported into the horizontal route R7*b* rises upward in the intermediate transporting apparatus 200 based on thermal property, thereby enabling a temperature of the sheet P to fall down. Further, heated air from the pair of guide plates constituting the horizontal route R7*b* rises upward in the intermediate transporting apparatus 200. Accordingly, temperature of the horizontal route R7*b* itself falls down at the same time.

By counter rotation of the rollers 236 under a transport control of the control part 250, a sheet transporting direction of the sheet P, which has been transported to the horizontal route R7*b* of the reverse-transporting route R7, is reversed. And the sheet P is transported to an inverse direction. The sheet P, the leading end and the trailing end of which along the transporting direction D1 are switched each other and a surface of which is reversed, is transported to the adjacent second image forming apparatus 300 through the ejection route R8.

On the other hand, when the image forming system GSD prints an image on one surface of the sheet P or prints images on the surface of the sheet P several times, the control part 250 controls the route-switching part 204 to switch the sheet transporting route to the straight transporting route R5 and controls the route-switching part 208 to switch the sheet transporting route to the ejection route R8.

The transporting rollers 202 transport the sheet P, on which has been done the fixing processing by the fixing portion 130 of the first image forming apparatus 100, to the straight transporting route R5. In this embodiment, since in the straight transporting route R5, the sheet P passes through the horizontal route thereof disposed at a position below the transporting route R1, heated air from the sheet P, temperature of which has risen by fixing processing in the first image forming apparatus 100, rises upward in the intermediate transporting apparatus 200 based on thermal property, thereby enabling temperature of the sheet P to fall down. The sheet P passing through the straight transporting route R5 is then transported to the ejection route R8 and is further transported to the second image forming apparatus 300 by the transporting rollers 234 and the like.

As described above, according to the fourth embodiment of this invention, the same effects are obtained, which are identical to those of the first embodiment of the invention. In other words, since the reverse-transporting route R7 on which a surface of the sheet P is reversed is arranged at a position below the transporting route R1, based on the thermal property on which heated air which has high temperature rises upward in the intermediate transporting apparatus 200, the sheet P transported from the transporting route R1 is cooled on the reverse-transporting route R7. Thus, the temperature of the sheet P, the temperature of which falls down, is transported to the second image forming apparatus 300 so that it is possible to prevent materials from being deteriorated in the second image forming apparatus 300 because of the temperature rise in the second image forming apparatus 300.

Further, according to the fourth embodiment of this invention, the cooling fans 290, 292 are respectively arranged at positions below the transporting route R1 and the reverse-transporting route R7 and around them. The cooling fans 290, 292 suck the air of the lower portion of the intermediate transporting apparatus 200 and blow it to the guide plates constituting the transporting route R1 and the reverse-transporting route R7 and the sheet P passing through the transporting route R1 and the reverse-transporting route R7. This enables the sheet P to be effectively cooled. Further, since the sheet P, temperature of which falls down, is transported to the second image forming apparatus 300, it is possible to prevent materials from being deteriorated in the second image forming apparatus 300 because of the temperature rise in the second image forming apparatus 300.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

Although in the above-mentioned first through fourth embodiments, it has been described that in the image forming systems GSA, GSB, GSC and GSD, the first image forming apparatus 100, the intermediate transporting apparatus 200 and the second image forming apparatus 300 are separately connected to each other, the present invention is not limited thereto. For example, the first image forming apparatus 100, the intermediate transporting apparatus 200 and the second image forming apparatus 300 may be configured so as to be united within one case. Further, the reverse configuration of the sheet-reversing mechanism 210 and the positions and numbers of the sensors are not limited to the above-described configurations. A user may set a start timing of the operation of each of the cooling fans 290, 292 and 294 optionally and the start timing of the operation thereof may be controlled on the basis of the temperature within the intermediate transporting apparatus 200.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming system comprising:

a first image forming apparatus to form an image on a first surface of a sheet while transporting the sheet so that a first edge among four edges of the sheet is to be a leading edge, wherein the first image forming apparatus heats the sheet to fix the image on the sheet;

a second image forming apparatus to form an image on a second surface of the sheet that is different from the first surface of the sheet on which the image has been formed by the first image forming apparatus, while transporting the sheet so that the first edge is to be the leading edge; and a transporting apparatus to transport the sheet from the first image forming apparatus to the second image forming apparatus, while keeping the first edge to be the leading edge of the sheet, wherein the transporting apparatus includes:

a first transporting part to transport the sheet to a predetermined position;

a second transporting part to reverse a surface of the sheet which has been transported by the first transporting part while transporting the sheet from the predetermined position to an area below the predetermined position, and to transport the sheet towards the second image forming apparatus; and a controller to control the first transporting part and the second transporting part;

wherein the second transporting part comprises:

a third transporting part to reverse the surface of the sheet while transporting the sheet so that a second edge of the sheet which is orthogonal to the first edge is to be a leading edge in a direction perpendicular to a transporting direction of the first transporting part; and a fourth transporting part to transport the sheet which has been transported by the third transporting part towards the second image forming apparatus, wherein the fourth transporting part transports the sheet in the transporting direction of the first transporting part.

2. The image forming system of claim 1, wherein the transporting apparatus further comprises a cooler to cool the sheet which is transported by the first transporting part.

3. The image forming system of claim 2, wherein the cooler is located under the first transporting part, sucks air below the first transporting part and blows air towards the first transporting part.

4. The image forming system of claim 1, wherein the transporting apparatus further comprises a cooler to cool the sheet which is transported by the second transporting part.

5. The image forming system of claim 4, wherein the cooler is located under the second transporting part, sucks air below the second transporting part, and blows air towards the second transporting part.

6. The image forming system of claim 1, wherein the transporting apparatus further comprises a cooler to suck air below the first transporting part and to exhaust air towards above the first transporting part, wherein the cooler is located above the first transporting part.

7. The image forming system of claim 1, wherein the transporting apparatus further comprises a fifth transporting part to transport the sheet on which the image is formed by the first image forming apparatus to the fourth transporting part without reversing the surface of the sheet, wherein the fifth transporting part is located under the first transporting part.

* * * * *